US008186166B2

(12) United States Patent
Varatharajan et al.

(10) Patent No.: US 8,186,166 B2
(45) Date of Patent: May 29, 2012

(54) HYBRID TWO FUEL SYSTEM NOZZLE WITH A BYPASS CONNECTING THE TWO FUEL SYSTEMS

(75) Inventors: Balachandar Varatharajan, Cincinnati, OH (US); Willy Steve Ziminsky, Simpsonville, SC (US); Ertan Yilmaz, Albany, NY (US); Benjamin Lacy, Greer, SC (US); Baifang Zuo, Simpsonville, SC (US); William David York, Greer, SC (US)

(73) Assignee: General Electric Company, Schenectady, NY (US)

( * ) Notice: Subject to any disclaimer, the term of this patent is extended or adjusted under 35 U.S.C. 154(b) by 526 days.

(21) Appl. No.: 12/181,329

(22) Filed: Jul. 29, 2008

(65) Prior Publication Data

US 2010/0024426 A1 Feb. 4, 2010

(51) Int. Cl.
*F02C 1/00* (2006.01)

(52) U.S. Cl. ..... 60/748; 60/742; 60/39.463

(58) Field of Classification Search ..... 60/734, 60/737, 739, 740, 742, 746, 748, 776, 780, 60/39.463
See application file for complete search history.

(56) References Cited

U.S. PATENT DOCUMENTS

| | | | | |
|---|---|---|---|---|
| 5,199,265 | A * | 4/1993 | Borkowicz | 60/737 |
| 6,438,961 | B2 | 8/2002 | Tuthill et al. | |
| 2004/0006993 | A1 * | 1/2004 | Stuttaford et al. | 60/776 |
| 2007/0130954 | A1 | 6/2007 | Lynch et al. | |
| 2007/0234735 | A1 | 10/2007 | Mosbacher et al. | |
| 2008/0078183 | A1 | 4/2008 | Ziminsky et al. | |
| 2008/0083229 | A1 | 4/2008 | Haynes et al. | |

* cited by examiner

*Primary Examiner* — William H Rodriguez
*Assistant Examiner* — Carlos A Rivera
(74) *Attorney, Agent, or Firm* — Sutherland Asbill & Brennan LLP

(57) ABSTRACT

A hybrid fuel combustion nozzle for use with natural gas, syngas, or other types of fuels. The hybrid fuel combustion nozzle may include a natural gas system with a number of swozzle vanes and a syngas system with a number of co-annular fuel tubes.

12 Claims, 3 Drawing Sheets

HYBRID TWO FUEL SYSTEM NOZZLE WITH A BYPASS CONNECTING THE TWO FUEL SYSTEMS

STATEMENT REGARDING FEDERALLY SPONSORED RESEARCH AND DEVELOPMENT

This invention has been made with government support under Contract Number DE-FC26-05NT42643 awarded by the U.S. Department of Energy. The government has certain rights in the invention.

TECHNICAL FIELD

The present application relates generally to gas turbine engines and more particularly relates to a hybrid fuel combustion nozzle for use with fuels having different characteristics.

BACKGROUND OF THE INVENTION

Various types of combustors are known and are in use in gas turbine engines. In turn, these combustors use different types of fuel nozzles depending upon the type of fuel in use. For example, most natural gas fired systems operate using lean premixed flames. In these systems, fuel is mixed with air upstream of the reaction zone for creating a premix flame. One example is a "swozzle" (swirler+nozzle) in which the fuel ports are positioned about a number of vanes. Alternatively in most syngas based systems, diffusion nozzles may be used that inject the fuel and air directly into the combustion chamber due to the higher reactivity of the fuel.

Due to the significant differences between the characteristics of natural gas and syngas in Wobbe number and fuel reactivity, traditional vane hole injector designs used for natural gas systems may create flame holding problems if used for syngas. Likewise, a diffusion nozzle may result in high $NO_X$ emissions unless a diluent is injected.

Alternative technology for syngas combustion is being developed that allows for some syngas premixing while reducing the potential for flame holding by using co-flow injection of the fuel into the air. Such an injection method, however, may not allow for stabilizing a natural gas flame.

There is thus a desire for a turbine combustion system that can operate with a variety of fuels with differing characteristics. The system should be fuel flexible while maintaining reduced emissions and high efficiency over a variety of operating conditions.

SUMMARY OF THE INVENTION

The present application thus provides a hybrid fuel combustion nozzle for use with natural gas, syngas, or other types of fuels. The hybrid fuel combustion nozzle may include a natural gas system with a number of swozzle vanes and a syngas system with a number of co-annular fuel tubes.

The present application further provides a method of operating a multi-fuel turbine. The method includes flowing a first fuel through a number of swozzle vanes, premixing the first fuel with air, flowing a second fuel through a plurality co-annular fuel tubes, diverting a portion of the second fuel to the swozzle vanes, and premixing the second fuel with air.

The present application further provides for a hybrid fuel combustion nozzle for use with a number of different types of fuels. The hybrid fuel combustion nozzle may include a first gas system with a number of swirl vanes, a second gas system with a number of fuel tubes, and a by-pass line extending from the fuel tubes to the swirl vanes.

These and other features of the present application will become apparent to one of ordinary skill in the art upon review of the following detailed description when taken in conjunction with the several drawings and the appended claims.

DETAILED DESCRIPTION

Figure 1:
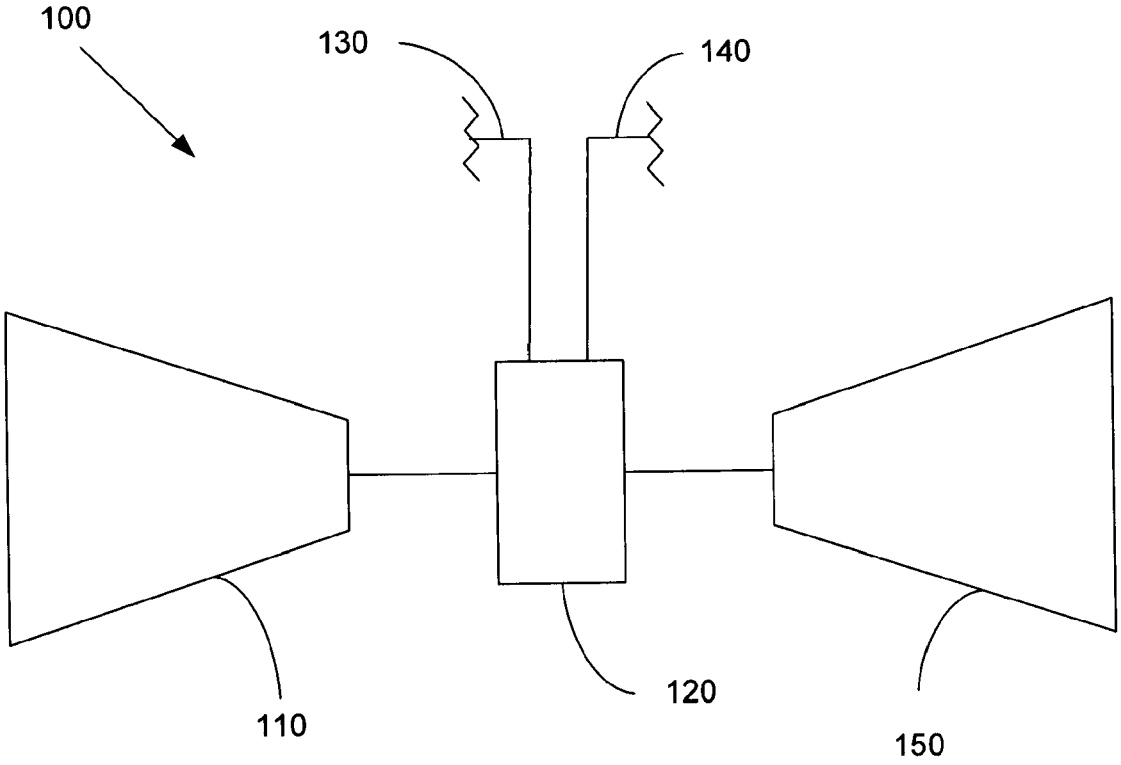
FIG. 1 is a schematic view of a turbine engine.

Referring now to the drawings, in which like numbers refer to like elements through the several views. FIG. 1 shows a schematic view of a multi-fuel gas turbine engine 100. The gas turbine engine 100 may include a compressor 110 to compress an incoming airflow. The compressed airflow is then delivered to a combustion system 120 where it is ignited with a fuel flow within a combustion chamber 125. The fuel may be a natural gas flow from a natural gas line 130 or a syngas flow from a syngas line 140. As is known, the fuel and the air may be mixed within the combustion system 120 and ignited. The hot combustion gases in turn are delivered to a turbine 150 so as to drive the compressor 110 and an external load such as an electrical generator and the like. The gas turbine engine 100 may use other configurations and components herein.

Figure 2:
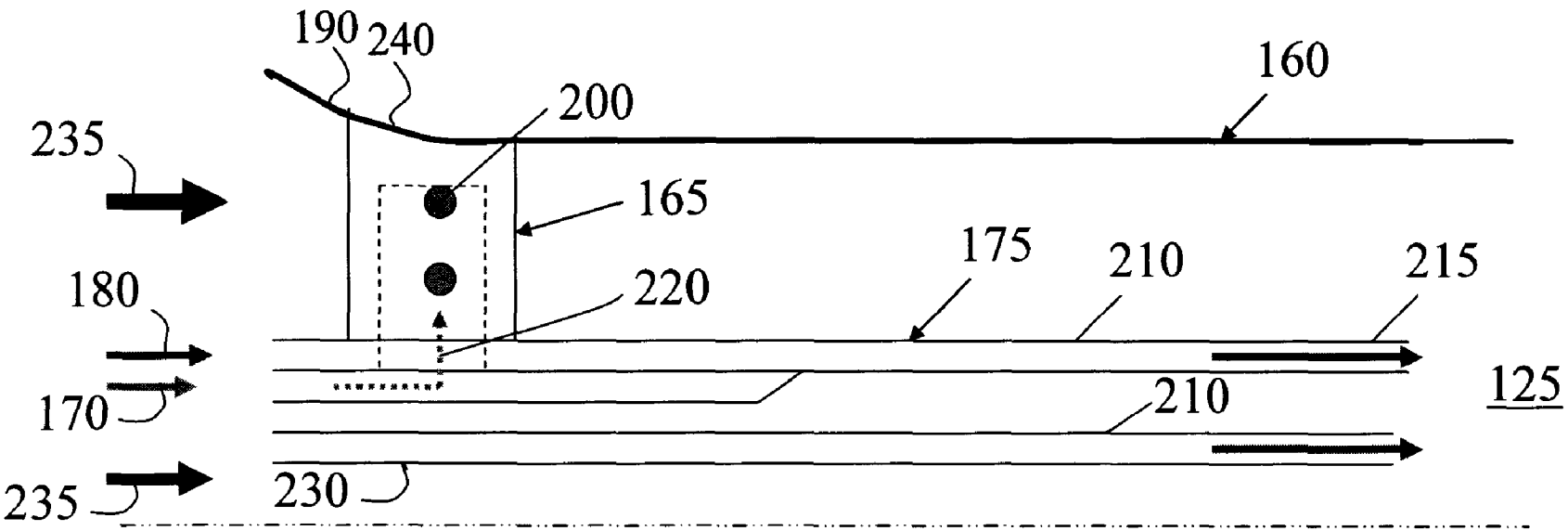
FIG. 2 is a schematic view of a hybrid fuel nozzle as may be described herein.
Figure 3:
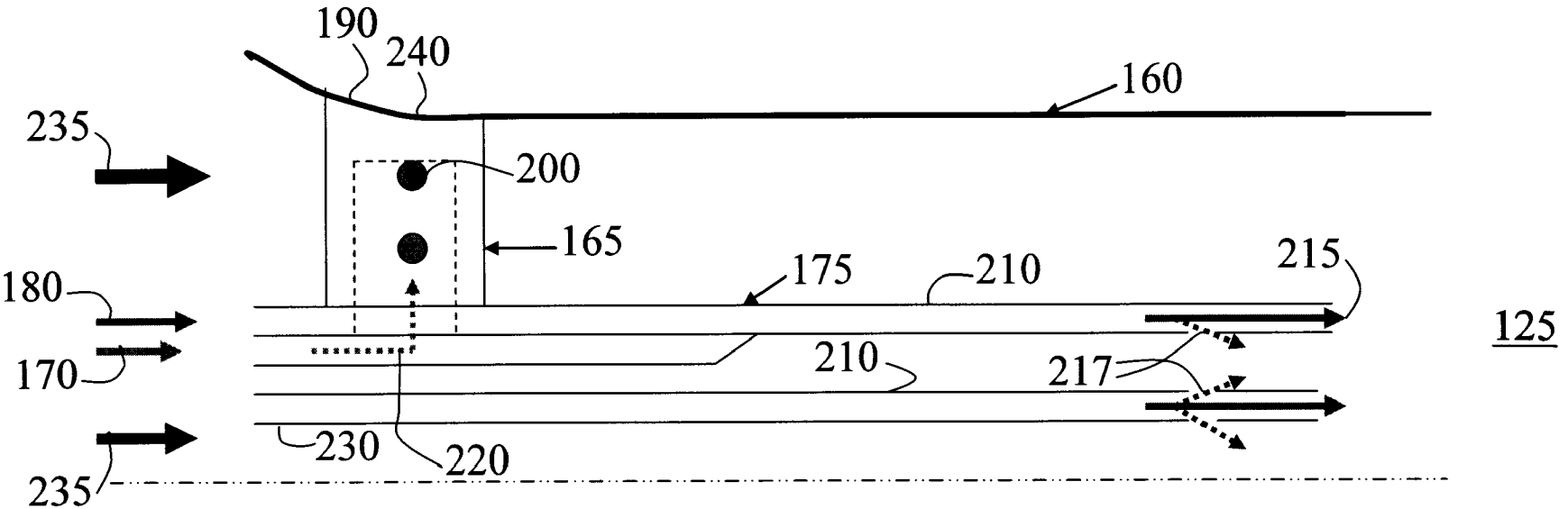
FIG. 3 is a further schematic view of a hybrid fuel nozzle as may be described herein

FIGS. 2 and 3 show a hybrid fuel nozzle 160 as is described herein. The hybrid fuel nozzle 160 may be used within the combustion system 120 to create a mixture of fuel and air for burning in the combustion chamber 125. The hybrid fuel nozzle 160 may include a natural gas system 165. The natural gas system 165 of the hybrid fuel nozzle 160 may include a natural gas inlet 170. The natural gas inlet 170 may be in communication with the natural gas line 130. The natural gas line 130 may have natural gas, syngas, or other fuels with similar characteristics therein.

The hybrid fuel nozzle 160 further may include a syngas system 175. The syngas system 175 of the hybrid fuel nozzle 160 may include a syngas inlet 180. The syngas inlet 180 may be in communication with the syngas line 140. The syngas line 140 may have a syngas with a range of hydrogen ($H^2$) fuels or fuels with similar characteristics. The volumetric flow rate of the syngas is generally much higher than that of natural gas.

The natural gas system 165 of the hybrid fuel nozzle 160 may include a number of swozzle vanes 190. As is known, the swozzle vanes 190 may include a number of injection ports 200. Each swozzle vane 190 may have one or more injection ports 200. The injection ports 200 may have an angled position on the swozzle vanes 190 or other type of configuration. Fuel may be injected on both the pressure and the suction side of the swozzle vanes 190. In this example, the swozzle vanes 190 may have a reduced swirl vane design although other designs may be used herein. The swozzle vanes 190 may maximize fuel/air mixing to meet performance requirements such as flame holding margin, flash back margin, and low emissions. The natural gas, syngas, or similar fuels introduced through the swozzle vanes 190 may be mixed with air passing through the vane cascade and ignited downstream of the nozzle 160 in the combustion chamber 125.

The syngas system 175 of the hybrid fuel nozzle 160 may include a number of co-annular fuel tubes 210 therein. The co-annular fuel tubes 210 may be in communication with the syngas inlet 180. The co-annular fuel tubes 210 may extend along the length of the hybrid fuel nozzle 160 and may exit via one or more orifices 215, one or more fuel injection ports 217, or through other types of structures. Other configurations and orientations may be used herein.

The co-annular fuel tubes 210 also may be in communication with a fuel bypass line 220. The fuel bypass line 220 allows some of the syngas to be delivered to the swozzle vanes 190 and the injection ports 200 of the natural gas system 165. A portion of the syngas flow thus may be ignited in a manner similar to that of the natural gas system 165 described above.

The syngas system 175 of the hybrid fuel nozzle 160 also may include a center syngas port 230 in communication with the syngas inlet 180. The center syngas port 230 also may include a further co-annular fuel tube 210 extending through the hybrid fuel nozzle 160 as described above and ending in one of the orifices 215, one of the fuel injection ports 217, or other types of structures. The use of the center syngas port 230 is optional. Other configurations and other numbers of co-annular fuel tubes 210 also may be used herein.

Air may enter the syngas fuel system 175 through a number of different air ports 235 including via a number of openings 240 positioned between the vanes 190. Any number and configuration of the air ports 235 and the openings 240 may be used. Air also may enter co-annularly about the natural gas inlet 170. Air flows around and between the co-annular fuel tubes 210 so as to provide some mixing with the syngas. Air also flows around the center syngas port 230. The air and the syngas may mix and be ignited downstream of the orifices 215. Likewise, air may enter the natural gas system 165 about the vanes 190 and the openings 240. The air and the syngas or natural gas exiting the natural gas system 165 may mix and be ignited downstream of the swozzle vanes 190 as is described above.

In use, natural gas passes through the natural gas line 130 and into the natural gas inlet 170 of the natural gas system 165. Natural gas then passes through the injector ports 200 of the swozzle vanes 190 and mixes with the air flowing therethrough for downstream ignition.

For syngas operation, syngas passes through the syngas line 140 into the syngas inlet 180 of the syngas system 175. Some of the syngas may enter the fuel bypass line 220 and may pass through the injection ports 200 of the swozzle vanes 190. The remainder of the syngas may pass through the co-annular fuel tubes 210 and may be mixed with the co-flow air entering via the air ports 235 or otherwise. The fuel and the air may exit via the orifices 215 and may be ignited downstream in the combustion chamber 125.

For syngas operation, the volumetric flow rate may be more than double that of the natural gas flow at the same adiabatic flame temperature and operating conditions. As such, the fuel pressure ratio would be very high if the fuel was injected only through the injection ports 200 of the swozzle vanes 190. Thus, for syngas operations both the injection ports 200 of the swozzle vanes 190 and the co-annular fuel tubes 210 may be used.

The co-fuel gas turbine engine 100 described herein thus has the flexibility to use natural gas, high $H^2$ gas, syngas, low $H^2$ gas, or other types of fuels depending upon demand and availability. The fuels are burned efficiently and within typical emissions standards.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A hybrid fuel combustion nozzle for use with a flow of natural gas, syngas, or other types of fuels with a flow of air, comprising:

a natural gas system;

the natural gas system comprising a fuel flowing through an injection port in at least one of a plurality of swozzle vanes;

a syngas system;

the syngas system comprising a plurality of co-annular fuel tubes placed radially inward of said swozzle vanes to provide a co-flow of the flow of natural gas, syngas, or other types of fuel and the flow of air; and a by-pass fuel line extending from the plurality of co-annular fuel tubes to the plurality of swozzle vanes for delivering a portion of the syngas through the swozzle vane injection port of the natural gas system.

2. The hybrid fuel combustion nozzle of claim 1, wherein the natural gas system comprises a natural gas inlet in communication with the plurality of swozzle vanes.

3. The hybrid fuel combustion nozzle of claim 1, wherein the syngas system comprises a syngas inlet in communication with the plurality of co-annular fuel tubes.

4. The hybrid fuel combustion nozzle of claim 1, wherein the plurality of co-annular fuel tubes comprises a plurality of orifices and/or a plurality of injection ports.

5. The hybrid fuel combustion nozzle of claim 1, wherein the syngas system comprises a center syngas port.

6. The hybrid fuel combustion nozzle of claim 1, further comprising a plurality of openings positioned about the plurality of swozzle vanes and in communication with the syngas system.

7. The hybrid fuel combustion nozzle of claim 1, further comprising one or more air ports.

8. A hybrid fuel combustion nozzle for use with a number of different types of fuels and a flow of air, comprising:

a first gas system;

the first gas system comprising a fuel flowing through an injection port in at least one of a plurality of swirl vanes;

a second gas system;

the second gas system comprising a plurality of co-annular fuel tubes placed radially inward of said swirl vanes to provide a co-flow of a second fuel and the flow of air; and a by-pass fuel line extending from the plurality of co-annular fuel tubes to the plurality of swirl vanes for delivering a portion of the second fuel through the swirler vane injection port of the first gas system.

9. The hybrid fuel combustion nozzle of claim 8, wherein the plurality of fuel tubes comprises a plurality of co-annular fuel tubes.

10. The hybrid fuel combustion nozzle of claim 8, wherein the plurality of fuel tubes comprises a plurality of orifices and/or a plurality of injection ports.

11. The hybrid fuel combustion nozzle of claim 8, wherein the second gas system comprises a center gas port.

12. The hybrid fuel combustion nozzle of claim 8, further comprising a plurality of openings positioned about the plurality of swirl vanes and in communication with the second gas system.

* * * * *